United States Patent [19]

Van Sloun

[11] Patent Number: 4,567,809

[45] Date of Patent: Feb. 4, 1986

[54] VELOCITY SENSITIVE SAFETY LINK APPARATUS

[75] Inventor: Peter H. Van Sloun, Hopkins, Minn.

[73] Assignee: Honeywell Inc., Minneapolis, Minn.

[21] Appl. No.: 480,643

[22] Filed: Mar. 31, 1983

[51] Int. Cl.[4] ..... F41F 5/02; F42B 13/42

[52] U.S. Cl. ..... 89/1.55; 102/221; 102/505

[58] Field of Search ..... 89/1.5 D, 1.5 R, 1.51–1.55; 102/505, 221, 222, 258

[56] References Cited

U.S. PATENT DOCUMENTS 3,956,964 5/1976 McGuire ..... 89/1.5 D
4,083,304 4/1978 Dexter ..... 89/1.55 X
4,167,887 9/1979 Magro ..... 89/1.5 D
4,299,157 11/1981 Burns et al. ..... 89/1.5 D
4,440,060 4/1984 Berkley ..... 89/1.55

FOREIGN PATENT DOCUMENTS 7507004 12/1975 Netherlands ..... 102/505

*Primary Examiner*—David H. Brown
*Attorney, Agent, or Firm*—Roger W. Jensen

[57] ABSTRACT

In combination with an actuable means which is adapted to be actuated by the unlocking of an initiation means connected thereto. A velocity sensitive safety link means for connecting a lanyard to said initiation means.

19 Claims, 15 Drawing Figures

VELOCITY SENSITIVE SAFETY LINK APPARATUS

BACKGROUND TO THE INVENTION

There are several fields where it is desirable to have a means for sensing relative velocity between a pair of objects or the equivalent and for actuating some appropriate actuable means upon such relative velocity reaching or exceeding a preselected value. Examples of the foregoing are automotive safety apparatus, e.g., seat belts, industrial machine safety apparatus, construction machine safety apparatus and military applications. A specific example of the latter is a submunition adapted to be ejected from a canister tube together with a plurality of other similar submunitions, all of which are connected by a lanyard and a web strap to the canister tube, the arrangement being such that upon the submunitions being ejected a certain distance away from the canister tube then through the tethering action from the webbing and the lanyards the lanyard will jerk or unlock a detonation sequence initiation means so as to arm the submunition rendering it then susceptible to detonation upon the occurrence of some further event, e.g., the approach of personnel and/or vehicles. An example of the preceding arrangement for dispensing submunitions is disclosed in my copending patent application, Ser. No. 394,086, now U.S. Pat. No. 4,466,322, Filed July 1, 1982 and entitled "DISPERSING MINE DISPENSER".

One safety hazard associated with a canister tube loaded with submunitions, as aforesaid, is that the entire canister could accidentally be tipped upside-down so that the submunitions contained therein would dump out. This type of accident, and other types of unintentional events, could result in the lanyards connected to each of the submunitions being jerked so as to unlock the detonation sequence initiation means connected thereto.

SUMMARY OF THE INVENTION

My invention provides a solution to the abovedescribed problem; my invention provides a velocity sensitive safety link means for connecting a lanyard to an initiation means, which, when unlocked, actuates an actuable means. Stated otherwise, my invention provides, in combination with an actuable means adapted to be actuated by the unlocking of an initiation means connected thereto, a velocity sensitive safety link means for connecting a lanyard to the initiation means.

DETAILED DESCRIPTION OF THE INVENTION

Figure 1:
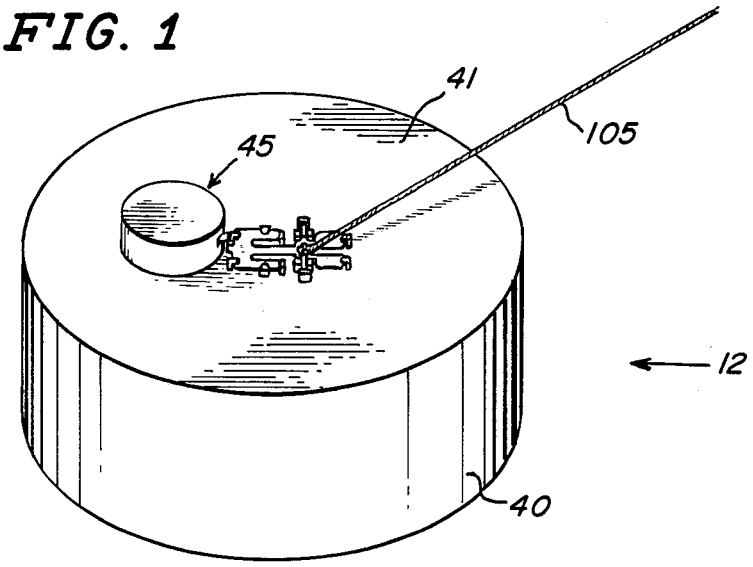
FIG. 1 depicts an actuable means in the form of a portable munition such as an antipersonnel or antiarmor mine.

Referring to FIG. 1, a submunition 12 which is adapted to be armed by the unlocking of a detonation sequence initiation means 45 is depicted comprising a substantially disc-like housing having a circular circumferential surface 40 and a pair of axial end surfaces, one of which, 41, is depicted in FIG. 1.

Figure 3:
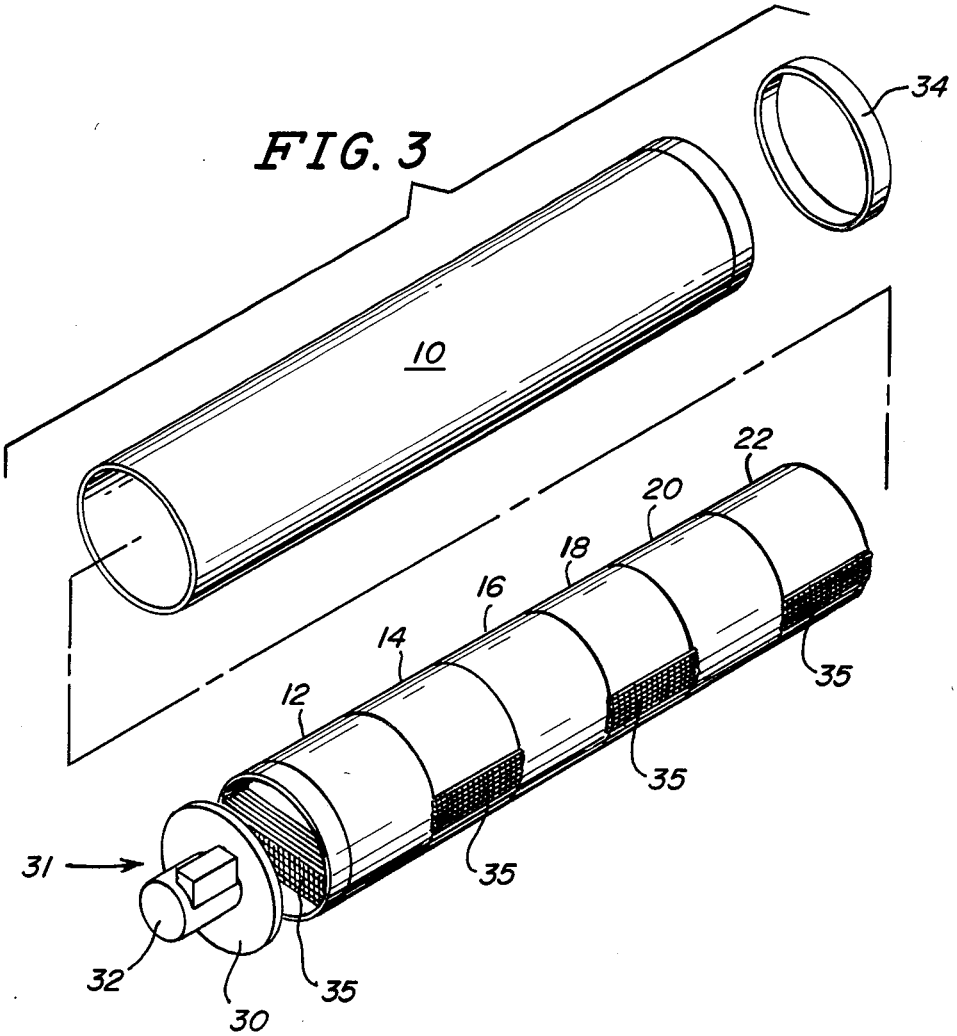
FIG. 3 depicts an exploded view of a munitions dispensing tube and a plurality of submunitions stored therein.

In FIG. 3 is depicted a canister tube 10 into which are adapted to be inserted a plurality of submunitions 12, 14, 16, 18, 20 and 22 through the assembly of which is looped a web strap 35, one end of which is adapted to be securely connected to the propulsion end piece 31, greater details of the preceding can be obtained from the above referenced co-pending application. Following the loading of the submunitions into the canister tube 10, the left end, as depicted in FIG. 3, is sealed off with a propulsion end piece 31 comprising an end plate 30 and a central hub-like portion 32 containing propulsion means, not shown. The other end of the canister tube 10 may, if desired, be closed off by a removable cover cap or end cap 34.

Figure 4:
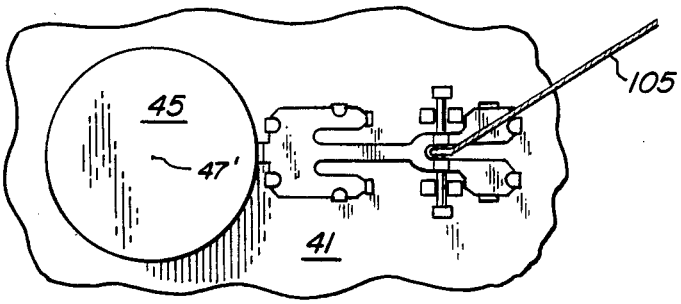
FIG. 4 is a top view of a portion of the apparatus shown in FIG. 1.
Figure 5:
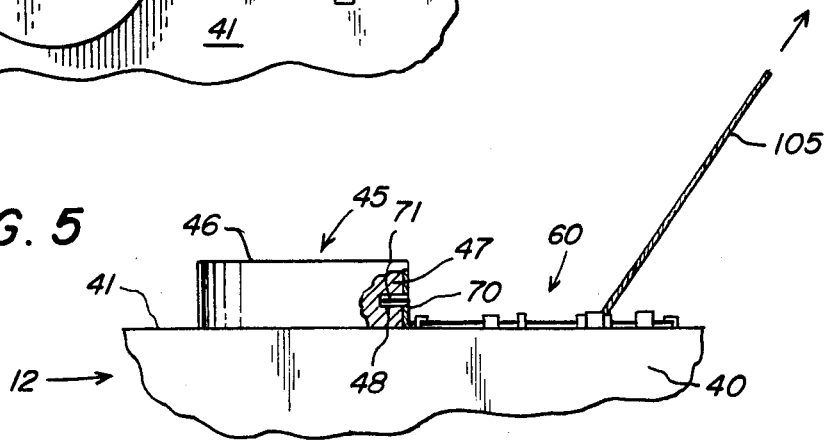
FIG. 5 is a side view of the apparatus shown in FIG. 4.
Figure 6:
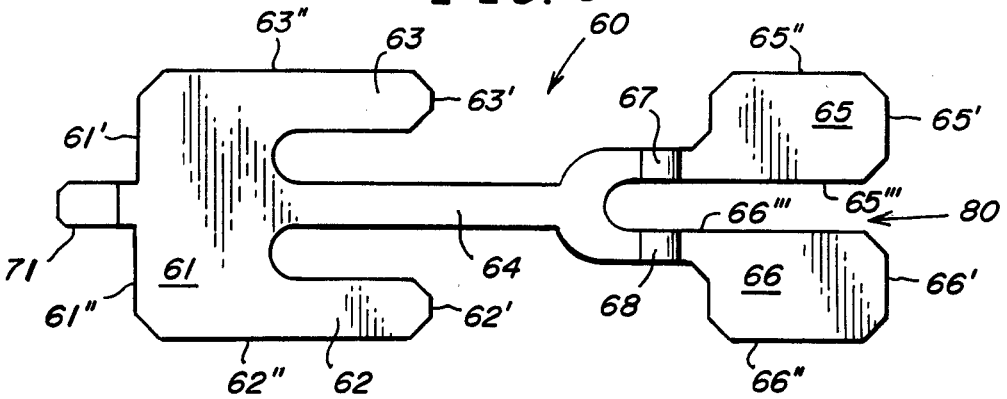
FIG. 6 is a plan view, enlarged, of a unique spring-like member utilized in my invention.
Figure 7:
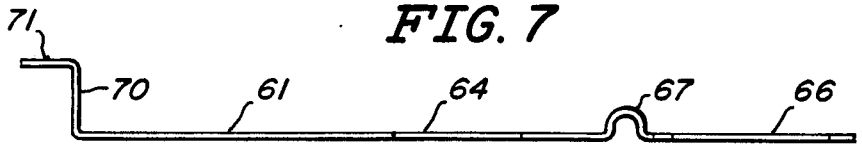
FIG. 7 is a side view of the apparatus depicted in FIG. 6.
Figure 8D:
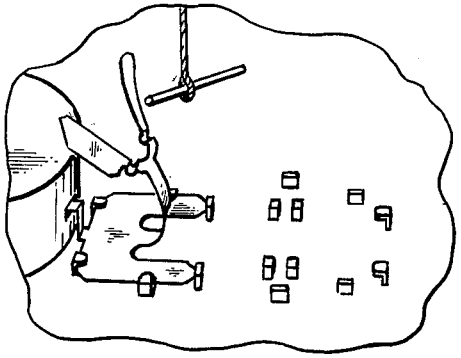
FIGS. 8A, 8B, 8C, and 8D are sequential views of the apparatus following a jerking of the lanyard at a relative velocity below a preselected velocity.

The detonation sequence initiation means 45 shown in FIG. 1 is also depicted in FIGS. 4 and 5, but only in rudimentary detail. It is sufficient for the purposes of this invention to consider only that the detonation sequence initiation means 45 contains a means or comprises a means which, when unlocked, will initiate a detonation sequence of the entire submunition 12. Those skilled in the art will recognize that there are many such arrangements which perform this general function. In FIG. 5 it is seen that the initiation means 45 comprises a housing 46 having a circular shape when viewed in FIG. 4 and a relatively short axial extent as viewed in FIG. 5. A member 47 contained within the housing 46 is adapted to rotate about a central axis 47' as viewed in FIG. 4. As depicted in FIG. 5, the internal member 47 is not free to rotate, i.e., it is locked against rotation because a tang portion 71 of a spring-like member 60 is engaged in a matching slot 48 of the member 47. Referring to FIGS. 6 and 7, it is seen that the spring-like member 60 comprises a square-like section 61 at one end thereof and an inertia section 65 and 66 at the other end thereof. More specifically, the square-like section 61 has a principal end surface 61' and 61'' at the left end thereof, as viewed in FIG. 6, from the center portion of which projects upwardly a narrow tab 70 at the top of which and at right angles thereto is the aforementioned release tang 71. The square-like section 61 further has a pair of arm-like members 62 amd 63 extending away from the edge 61'–61'', the outward or transverse edges of which are respectively identified by reference numerals 62'' and 63'' and the extreme right ends of which are identified by reference numeral 62' and 63' respectively.

The inertia section can also be described as a pair of inertia tabs 65 and 66 connected, as shown in FIG. 6, at their left ends to a stem 64, the other end of which is integral with the square-like section 61. Tabs 65 and 66 are spaced apart, in a transverse sense, with respect to the main longitudinal axis of the spring-like member 60. As depicted in FIG. 6, the extreme right edges of tabs 65 and 66 are identified by reference numberals 65' and 66', their outward surfaces by reference numeral 65'' and 66'' and their inward surfaces by reference numeral 65''' and 66''', a slot 80 being defined between surfaces 65''' and 66'''.

Means are provided integral with said spring-like member for providing a seat means for releasably positioning pull rod means 103 adapted to be connected to a lanyard 105 (see FIG. 9D), the other end of the lanyard in turn being adapted to be connected to the web strap 35. As depicted in FIGS. 6 and 7 the seat means for releasably positioning the pull rod means are a pair of curved portions 67 and 68 positioned intermediate the tabs 65 and 66 respectively and the stem 64, the portions 67 and 68 being depicted as relatively close to the junction of the tabs 65 and 66 with the stem 64.

Figure 9D:
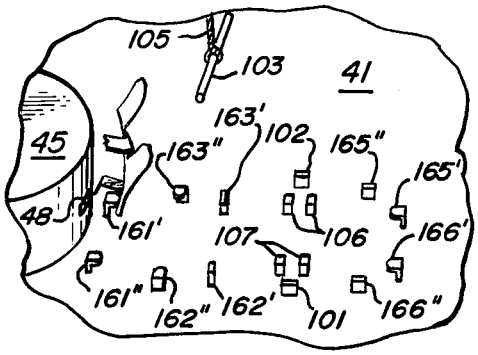
FIG. 9A, 9B, 9C, and 9D are sequential views of the inventive apparatus showing the functioning of the apparatus following a jerking of the lanyard at a relative velocity at or above the aforesaid preselected critical velocity.
Figure 9C:
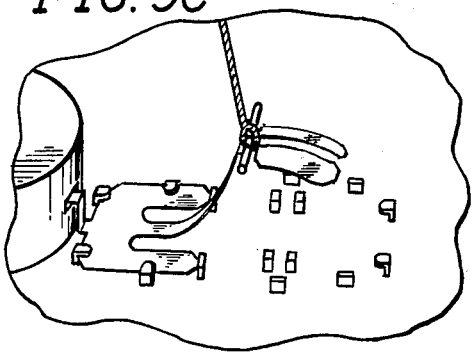

The spring-like member 60 is adapted to be releasably connected to the munition 12 by hold-down means depicted in various views and specifically indentified by reference numerals in FIG. 9D. More specifically, in FIG. 9D the hold-down means are identified by reference numerals 161', 161'', 162', 162'', 163', 163'', 165', 165'', 166' and 166''. The hold-down means may take various forms, the arrangement depicted in FIG. 9D being simple vertically projecting members projecting upwardly from the surface 41 of the munition 12, the projections 162', 163', 166'' and 165'' serving primarily the function of being guide members while the remaining hold-down means, specifically identified, each having at the top thereof a cap portion projecting inwardly a short distance as is clearly depicted in FIG. 4.

The pull rod means 103 is depicted as a simple short shaft adapted to be connected at its mid-point to a lanyard means 105 and to be positioned on the surface 41 of the munition between a pair of axial end stops 101 and 102 and two sets of transverse guides 106 and 107.

In operation, the pull rod 103 with lanyard 105 attached thereto as depicted, is adapted to be positioned between the aforesaid guide means 101, 102, 106 and 107. The spring-like member 60 is then inserted into position with the release tang 71 inserted into the matching slot 48 as shown in FIG. 5 and with the various edge surfaces identified in FIG. 6 abutting the corresponding hold-down means identified in FIG. 9. For example, surfaces 61' and 61'' at the left end (as shown in FIG. 6) of square-like section 61 are respectively abutted against the hold-down means 161' and 161'', etc.

OPERATION OF THE INVENTION

If the lanyard means 105 is pulled so as to pull the pull rod means 103 away from the surface 41 of the submunition 12 at a relatively low acceleration, then the apparatus functions as is depicted in FIG. 8. In FIG. 8A the lanyard 105 has been jerked and the pull rod 103 is starting to flex spring-like member 60. FIGS. 8B, C, and D depict successive views of the spring-like member as the lanyard and pull rod means move further away from the surface 41. In FIG. 8B it is seen that the square-like section 61 remains in place with flexure of the stem portion 64 occurring and with the two inertia tabs 65 and 66 being disengaged from their associated hold-down means by moving somewhat to the left, as shown in the Figure. In FIG. 8D it is shown that the square-like section 61 remains in its initial position, resulting in the release tang 71 continuing to perform its function of locking the detonation sequence initiating means, and with the pull rod means and the lanyard means attached thereto being disengage from the spring-like member by relative movement therebetween along the slot 80.

Figure 8C:
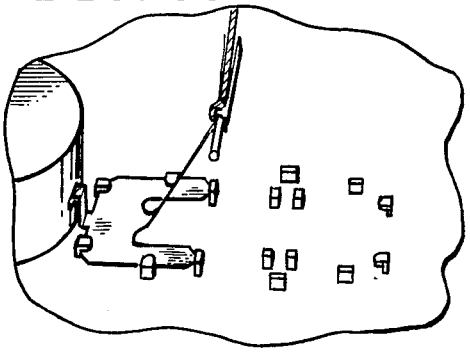
Figure 8B:
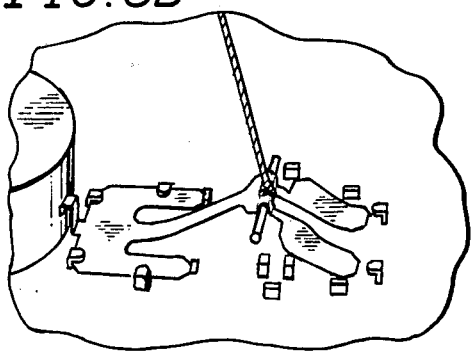
Figure 9B:
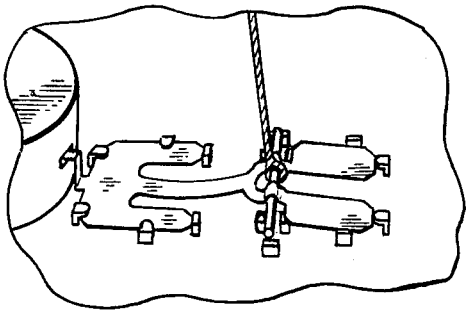
Figure 8A:
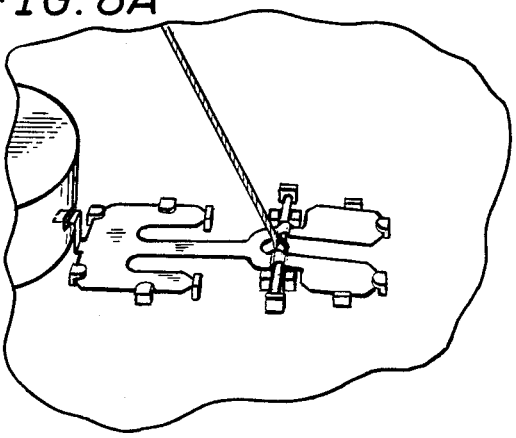
Figure 9A:
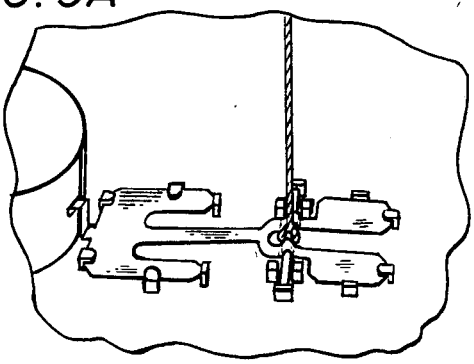

FIG. 9 shows the sequential views of the apparatus when the lanyard is jerked at an acceleration above a preselected or critical acceleration. In FIG. 9A the apparatus is shown just slightly after the upward force on lanyard 105 has been supplied to the hold-down means. In FIG. 9B the separation has increased. Because of the inertia of the tabs 65 and 66 in combination with the greater velocity of relative movement between the lanyard and the submunition, there is a tendency for the tabs 65 and 66 to remain in position to a much greater extent than was the case as depicted in FIG. 8B. This in turn results in a tendency for a tension force to be developed in the stem 64 to buckle members 62 and 63 from under hold downs 162'' and 163''. This effect is demonstrated even more graphically in FIG. 9C where the tabs 65 and 66 are fully disengaged and buckling disengagement of the square-like section 61 is commencing. Finally, in FIG. 9D the square-like section 61 has also fully disengaged from its associated hold-down means and the release tang 71 has also disengaged from its matching or mating recess 48 to thereby unlock the detonation sequence initiation means 45.

The spring-like member 60 may be made out of any suitable material, spring steel being acceptable. For economy purposes, member 60 may be a stamping although those skilled in the art will appreciate that other arrangements may be utilized too, such as the inertia tabs 65 and 66 having their mass increased as desired by being made out of thicker material than say, for example, the stem 64.

Figure 2:
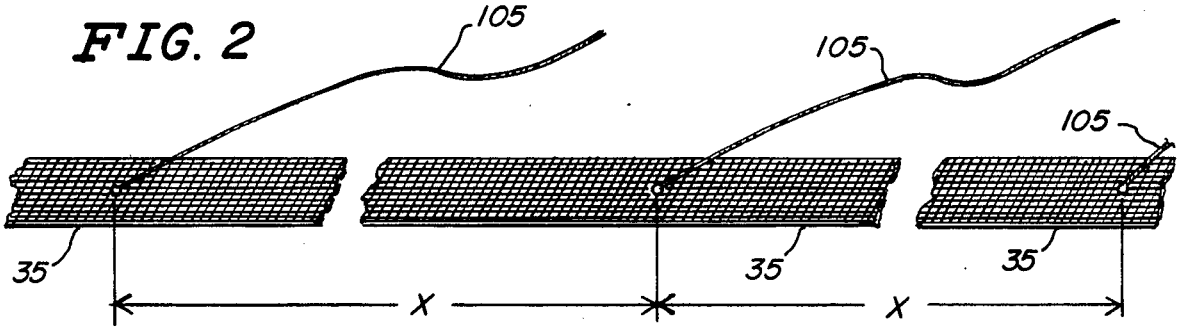
FIG. 2 shows a portion of the web strap associated with a complete munition dispensing system.

The apparatus shown in FIG. 2 is a simplified depiction of the webbing or web strap 35 associated with the munitions depicted collectively in FIG. 3. Here it will be noted that at uniform intervals a plurality of lanyard cords or means 105 are connected at one end, it being understood that the other ends of the lanyard 105 would be connected as shown in FIGS. 4, 5, 8, and 9 to a pull rod means 103.

What I claim is:

1. In combination:

(A) means adapted to be actuated upon the unlocking of an initiation means connected thereto; and (B) velocity sensitive safety link means for connecting a lanyard to said initiation means, said safety link means comprising:

(a) an enlogated generally flat thin spring-like member having (i) a square-like section at one end thereof, and (ii) an inertia section at the other end thereof, said inertia section having an elongated stem portion connected at one end thereof to said square-like portion, (b) hold-down means connected the first named means for releasably securing said spring-like member on a surface of said first named means adjacent to said initiation means, and (c) pull rod means positioned (i) between said spring-like member and said surface of said actuable means, (ii) intermediate said two ends of said spring-like member, and (iii) with the longitudinal axis of the rod transverse to said elongated stem portion, said pull rod means further being connected to a lanyard.

2. Apparatus of claim 1 further characterized by said inertia section comprising a pair of spaced apart inertia tabs.

3. Apparatus of claim 1 wherein said spring-like member includes seat means for releasably positioning said pull rod means between said spring-like member and said surface.

4. Apparatus of claim 3 wherein said seat means is proximate to the juncture of said stem portion and said inertia section.

5. Apparatus of claim 1 further characterized by said inertia section comprising a pair of inertia tab each connected at one end thereof to said stem portion and with said pair of inertia portions being separated transversely so as to define an open-ended slot therebetween.

6. Apparatus of claim 5 wherein said spring-like member includes seat means for releasably positioning said pull rod means between said spring-like member and said surface.

7. Apparatus of claim 6 wherein said seat means is proximate to the juncture of said stem portion and said inertia section.

8. Apparatus of claim 7 wherein said seat means comprises a pair of curved recesses respectively integral with said pair of inertia portions and in mutual alignment for receiving said pull rod means.

9. Apparatus of claim 8 wherein said pair of curved recesses are located near the closed end of said slot.

10. In combination:

(A) a munition adapted to be armed by the unlocking of a detonation sequence initiation means therein; and (B) velocity sensitive safety link means for connecting an arming lanyard to said detonation sequence initiating means, said safety link means comprising:

(a) an elongated generally flat thin spring-like member having (i) a square-like section at one end thereof, (ii) a release tang at said one end integral with said square-like section and, (iii) an inertia section at the other end thereof integral with said square-like section, said inertia section having an elongated stem portion connected at one end thereof to said square-like portion, (b) hold-down means connected to said munition for releasably securing said spring-like member on a surface of said munition adjacent to said detonation sequence initiation means and with said release tang of said spring-like member engaged with said detonation sequence initiation means, and (c) pull rod means positioned (i) between said spring-like member and said surface of said munition, (ii) intermediate said two ends of said spring-like member, and (iii) with the longitudinal axis of the rod transverse to said elongated stem portion, said pull rod means further being connected to an arming lanyard.

11. Apparatus of claim 10 further characterized by said inertia section comprising a pair of spaced apart inertia tabs.

12. Apparatus of claim 10 wherein said spring-like member includes seat means for releasably positioning said pull rod means between said spring-like member and said surface of said munition.

13. Apparatus of claim 12 wherein said seat means is proximate to the juncture of said stem portion and said inertia section.

14. Apparatus of claim 10 further characterized by said inertia section comprising a pair of inertia tabs each connected at one end thereof to said stem portion and with said pair of inertia tabs being separated transversely so as to define an open-ended slot therebetween.

15. Apparatus of claim 14 wherein said spring-like member includes seat means for releasably positioning said pull rod means between said spring-like member and said surface of said munition.

16. Apparatus of claim 15 wherein said seat means is proximate to the juncture of said stem portion and said inertia section.

17. Apparatus of claim 16 wherein said seat means comprises a pair of curved recesses respectively integral with said pair of inertia portions and in mutual alignment for receiving said pull rod means.

18. Apparatus of claim 17 wherein said pair of curved recesses are located near the closed end of said slot.

19. A generally plane spring-like member having a first end, a second end, and a flexible member interconnecting said ends;

means releasably applying to said flexible member a force having a component normal to the surface of the members;

means geometrically resisting movement of said first end of said member in response to said force; and means intertially resisting movement of said second end of said member in response to said force.

* * * * *